US005724734A

United States Patent [19]

Hirose et al.

[11] Patent Number: 5,724,734

[45] Date of Patent: Mar. 10, 1998

[54] METHOD OF FORMING A TAPPET IN AN INTERNAL COMBUSTION ENGINE

[75] Inventors: Masahito Hirose, Hayama-cyo; Kazufumi Nakamura, Fujisawa, both of Japan

[73] Assignee: Fuji Oozx Inc., Kanagawa-Ken, Japan

[21] Appl. No.: 561,845

[22] Filed: Nov. 22, 1995

[51] Int. Cl.[6] ..... B23P 15/00

[52] U.S. Cl. ..... 29/888.43; 29/888.4

[58] Field of Search ..... 29/888.43, 888.4; 123/90.51; 419/38, 26, 28

[56] References Cited

U.S. PATENT DOCUMENTS

| | | | |
|---|---|---|---|
| 4,251,273 | 2/1981 | Smith et al. | 148/126 |
| 4,667,627 | 5/1987 | Matsui et al. | 123/193 P |
| 5,310,519 | 5/1994 | Blaimschein | 419/47 |
| 5,537,744 | 7/1996 | Hirose | 29/888.43 |

FOREIGN PATENT DOCUMENTS

| | | |
|---|---|---|
| A-0 015 520 | 9/1980 | European Pat. Off. . |
| A-0 097 027 | 12/1982 | European Pat. Off. . |
| A-0 572 112 | 12/1993 | European Pat. Off. . |

*Primary Examiner*—Irene Cuda

*Attorney, Agent, or Firm*—Oppenheimer Poms Smith

[57] ABSTRACT

To manufacture a tappet in an internal combustion engine, a tappet rough body which comprises a cylindrical portion with an upper wall and an annular side wall is moulded by press processing of metal powder, such that the upper wall, the cylindrical portion and the annular side wall become larger than the tappet to be manufactured in the axial size. After sintering the tappet rough body, it is re-compressed to form the final tappet.

6 Claims, 1 Drawing Sheet

METHOD OF FORMING A TAPPET IN AN INTERNAL COMBUSTION ENGINE

BACKGROUND OF THE INVENTION

This invention relates to a method of forming a tappet which is used in a direct-acting valve-operating mechanism in an internal combustion engine, and espcially to a method of forming a steel tappet.

This type of tappet comprises a cylindrical portion with an upper wall, the portion being engaged in an engagement bore of a cylinder head, an annular side wall in which a shim for contacting a cam is inserted, on the upper surface of the upper wall, a thickened portion which contacts a valve, at the lower surface of the upper wall, and an annular groove for taking off pressure at the corner between the outer circumference of the upper wall and an annular side wall.

When such a tappet is manufactured, material such as soft steel is moulded to almost final shape by cold forging, heat treatment such as carburizing and hardening is carried out to provide a desired mechanical strength and wear resistance. Then, warp is corrected, and mechanical processing is made to the outer circumferential surface, the annular side wall, the upper surface of the upper wall, the thickened portion and the annular groove. In the conventional method of forming a tappet, carbuvizing and hardening require complicated troublesome steps, and there are a number of portions which are subject to mechanical processing, which takes a lot of time, thereby causing low productivity and high cost.

In view of the disadvantages, it is an object of the present invention to provide a method of forming a tappet which provides high strength and wear resistance without heat treatment, mechanical processing being omitted to increase productivity.

To achieve the object, according to the present invention, there is provided a method of forming a tappet in an internal combustion engine, the tappet comprising a cylindrical portion with an upper wall, and an annular side wall for a shim which contacts a cam, the cylindrical portion being fitted in an engagement bore of a cylinder head, the annular side wall being formed continuosly with the cylindrical portion at an outer circumference of the upper wall, the method comprising the steps of making press processing to metal powder such that a tappet rough body which comprises said cylindrical portion and the upper side wall becomes larger than the tappet to be manufactured in axial size; sintering the tappet rough body; and carrying out re-compression processing to make the final tappet.

The tappet rough body is optionally set by press processing of metal powder, so that the shape similar to the final product can be made in an initial step. Therefore, moulding is easily made in a short time compared with a conventional cold forging. By applying powder metallurgy such as sintering of the tappet rough body, carbon contents are easily controlled in the material, thereby omitting complicate troublesome steps such as the conventional carburizing and hardening. Only a few portions may be finished since each portion is finished to regular shape by sizing after sintering.

While the density of the whole tappet rough body is formerly determined, the density of portions to be strengthened may be increased and compacted by re-compression processing after singering, so that the strength of the portions which are subject to high stress can be easily increased.

The portions to be compacted may be the upper wall, a connecting portion between the upper wall and the cylindrical portion and a connecting portion between the upper wall and the annular side wall, so that the skirt of the cylindrical portion which need not so high strength becomes low density and increases oil-maintenance capability of lubricating oil since it is still porous after sintering.

BRIEF DESCRIPTION OF THE DRAWINGS

The features and advantages of the present invention will become more apparent from the following description on the basis of drawings wherein.

DETAILED DESCRIPTION OF PREFERRED EMBODIMENT

Figure 1:
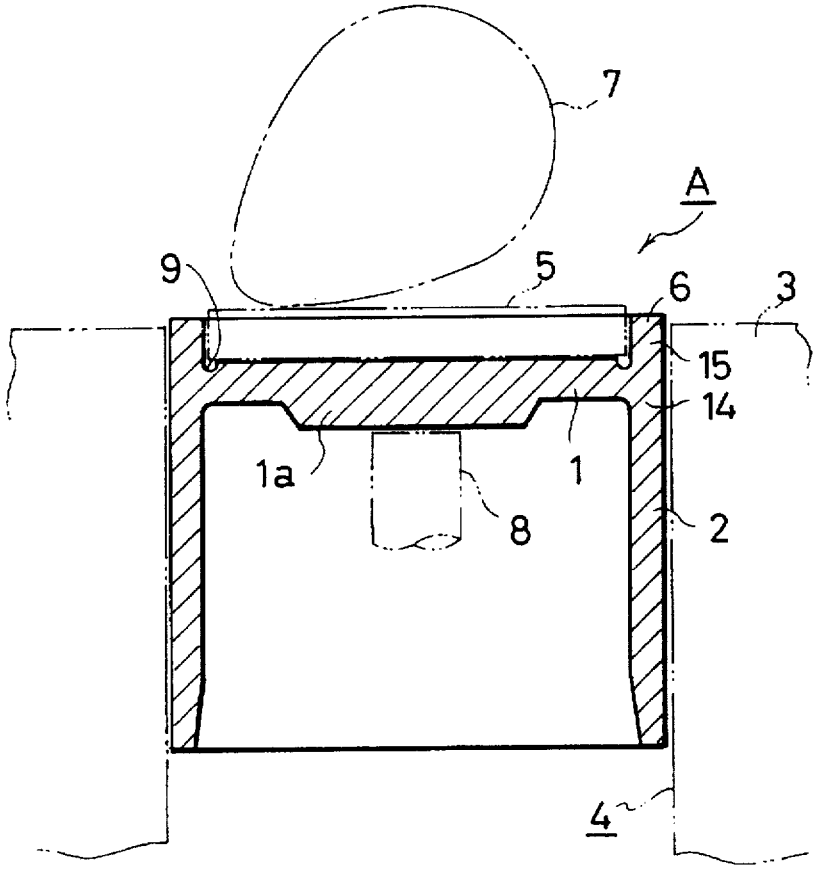
FIG. 1 is a sectional view which shows the structure of a tappet manufactured by a method of the present invention.

As shown in FIG. 1, a tappet manufactured in this embodiment has a cylindrical portion 2 closed by an upper wall 1. The cylindrical portion 2 is slidable in an engagement bore 4 of a cylinder head 3 up and down. At the upper surface of the upper wall 1, there is provided an annular side wall 6 in which a shim 5 for adjusting valve clearance is inserted. The upper surface of the shim 5 which is inserted in the annular side wall 6 is engaged on a cam 7 for driving a valve. A thickened portion la is formed on the lower surface of the upper wall 1. The upper end of a valve 8 is engaged with the thickened portion 1*a*.

In the corner of the upper peripheral surface of the upper wall 1 and the annular side wall 6, there is formed a U-sectioned annular groove 9 for absorbing stress caused by engagement with the shim 5.

Figure 2A:
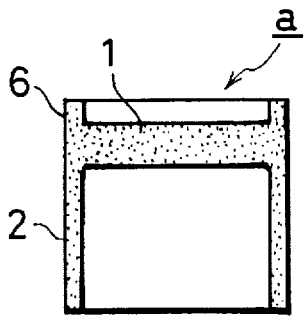
FIG. 2 illustrates the steps of the method of the present invention.

In the embodiment as shown in FIG. 2(A), owing to prior press processing of metal powder, a tappet body "a" which has a cylindrical portion 2 with an upper wall 1 and an annular side wall 6 is molded such that the height of the upper wall 1 and the cylindrical portion 2 and the annular side wall 6 is larger than that of a tappet "A" to be manufactured. In the step of forming the tappet rough body "a", the above thickened portion 1*a* is not formed to a desired form. The density of the whole tappet rough body "a" is set to be relatively low, such as 6.6 to 6.8 g/cm$^3$, compared with a tappet "A" as a final product.

Figure 2B:
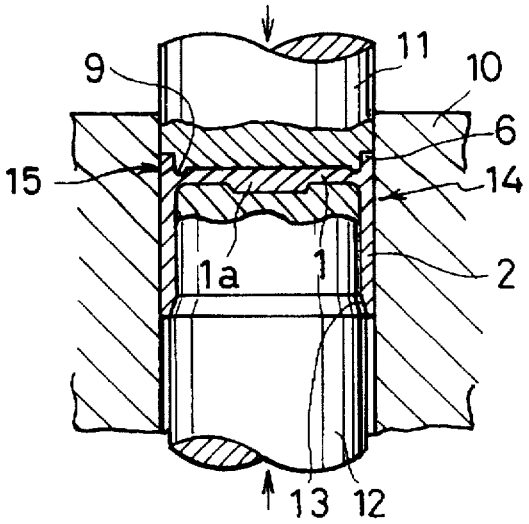

Then, the tappet rough body "a" is sintered to a certain temperature at a sintering finance (not shown), and plastic processing is carried out to the sintered tappet body "a" to a final form. As shown in FIG. 2(B), the tappet rough body "a" is put into a die 10, and is strongly pressed by upper and lower punches 11 and 12, thereby forming a tapered portion 13 which comprises the thickened portion 1*a*, the upper wall 1, the annular side wall 6, the annular groove 9 and the cylindrical portion 2 to a regular size and shape. In the plastic processing, the portion which should be strengthened is applied by recommission such as sizing and coining, and is compacted.

The portions to be strengthened are a connecting portion 14 between the upper wall 1 and the cylindrical portion 2; a connecting portion 15 between the upper wall 1 and the annular side wall 6; and the thickend portion 1*a* on the lower surface of the upper wall 1. In the conncecting portion 14 between the upper wall 1 and the cylindrical portion 2 and the connecting portion 15 between the upper wall 1 and the annular side wall 6, when the cam 7 is driven by the tappet "A", large bending stress is applied near the engagement bore 4 of the cylinder head, and compression stress is applied to the thickened portion 1*a* of the upper wall 1 by contacting the upper end of the valve 9, so that it is necessary to increase the strength therein.

The density of the portions to be compacted is preferably 7.0 to 7.2 g/cm$^3$, thereby increasing porosity of a skirt portion of the cylindrical portion 2, to keep porous condition in sintering.

The tappet "A" manufactured by the foregoing method in this embodiment comprises Fe-matrix alloy as shown in (1) to (3) (% by weight):

(1) Ni(1.75%)—Cu(1.5%)—Mo(0.5%)—Fe(balance)

(2) Cu(2.0%)—C(0.5%)—Fe(balance)

(3) C(0.6%)—Fe(balance)

According to the foregoing method, the tappet rough body "a" is optionally determined in shape by press processing of metal material powder, so that the shape similar to the final product is determined in the initial step, thereby facilitating molding in a short time compared with a conventional cold forging.

powder metallurgy such as sintering of the tappet rough body "a" is employed in raw material, thereby omitting complicate troublesome steps such as conventional carburizing and hardening. Also, re-compression treatment such as sizing is carried out to the tappet rough body "a" after sintering, so that each part becomes similar to the final shape, so that a few portions such as the outer circumferential surface of the cylindrical portion 2 and the upper surface of the upper wall 1 may be finished, thereby reducing the steps of mechanical processing and increasing productivity.

Furthermore, the density during molding of the tappet rough material "a" is formerly determined to be low, and the density of the portions to be strengthened is increased by sizing after sintering, and the corresponding strength is applied to the portions which are subject to high stress, and the portions such as the skirt portion of the cylindrical portion 2 are kept in low density to provide porous condition after sintering, thereby increasing oil-maintenance capability and lubricating properties. The stress-acting portions of tappets in an engine are strengthened easily and surely, such as the connecting portion 14 between the upper wall 1 and the cylindrical portion 2, the connecting portion 15 between the upper wall 1 and the annular side wall 6, and the thickened portion 1*a* of the upper wall which contacts the valve.

In the foregoing embodiments, the annular groove 8 is formed in re-compression step such as sizing, but can be made by finishing the upper surface of the upper wall 1. At the lower surface of the upper wall 1, there is provided the thickened portion 10 which contacts the valve, but a flat surface may be formed without such thickened portion 10.

The foregoings merely relate to an embodiment of the present invention. Various modifications and changes may be made by person skilled in the art without departing from the scope of claims wherein:

What is claimed is:

1. A method of forming a tappet in an internal combustion engine, the tappet comprising a cylindrical portion with an upper wall, and an annular side wall for a shim which contacts a cam, the cylindrical portion being fitted in an engagement bore of a cylinder head, the annular side wall being formed continuously with the cylindrical portion at an outer circumference of the upper wall, the method comprising the steps of:

press processing a metal powder to form a tappet rough body which comprises said cylindrical portion such that the upper side wall becomes larger than the tappet to be manufactured in axial size;

sintering the tappet rough body; and carrying out re-compression processing to strengthen the upper wall a connecting portion between the upper wall and the cylindrical portion, and a connecting portion between the upper wall and the annular side wall to make a final tappet.

2. A method as defined in claim 1 wherein there is provided an annular groove in a corner between the annular side wall and an upper wall of the upper surface to absorb stress caused by engagement with the shim.

3. A method of forming a tappet in an internal combustion engine, the tappet comprising a cylindrical portion with an upper wall, and an annular side wall for a shim which contacts a cam, the cylindrical portion being fitted in an engagement bore of a cylinder head, the annular side wall being formed continuously with the cylindrical portion at an outer circumference of the upper wall, the method comprising the steps of:

press processing a metal powder to form a tappet rough body comprising said cylindrical portion;

sintering said tappet rough body; and re-compressing a selected portion of said tappet rough body to form a final tappet wherein said selected portion is denser than another portion of said final tappet.

4. A method as defined in claim 1 wherein said selected portion comprises the upper wall.

5. A method as defined in claim 1 wherein said selected portion comprises a connecting portion between the upper wall and the cylindrical portion.

6. A method as defined in claim 1 wherein said selected portion comprises a connecting portion between the upper wall and the annular side wall.

* * * * *